US007091922B2

(12) United States Patent
Parsons et al.

(10) Patent No.: US 7,091,922 B2
(45) Date of Patent: Aug. 15, 2006

(54) LASER ALIGNMENT APPARATUS AND METHOD

(75) Inventors: Barry Frederick Parsons, Eastwood (AU); Christophe Jean-Marc Granet, Ryde (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 18 days.

(21) Appl. No.: 10/344,039

(22) PCT Filed: May 30, 2002

(86) PCT No.: PCT/AU02/00691

§ 371 (c)(1),
(2), (4) Date: May 28, 2003

(87) PCT Pub. No.: WO03/007419

PCT Pub. Date: Jan. 23, 2003

(65) Prior Publication Data

US 2004/0125037 A1 Jul. 1, 2004

(30) Foreign Application Priority Data

Jul. 9, 2001 (AU) ..... PR6229

(51) Int. Cl.
*H01Q 13/00* (2006.01)
*H01Q 1/10* (2006.01)

(52) U.S. Cl. ..... 343/781 P; 343/882; 343/757; 343/763; 343/781 CP

(58) Field of Classification Search ..... 343/781 P, 343/781 CA, 882–883, 757, 763, 761, 880, 343/881, 766, 765
See application file for complete search history.

(56) References Cited

U.S. PATENT DOCUMENTS

| | | | | |
|---|---|---|---|---|
| 3,816,000 | A | 6/1974 | Fiedler | 356/141.3 |
| 3,891,160 | A * | 6/1975 | Minovitch | 244/158 R |
| 4,590,481 | A | 5/1986 | Burditt | 343/840 |
| 5,107,369 | A * | 4/1992 | Hendrickson et al. | 359/399 |
| 5,162,811 | A | 11/1992 | Lammers et al. | 343/915 |
| 5,455,670 | A * | 10/1995 | Payne et al. | 356/5.1 |
| 6,630,912 | B1 * | 10/2003 | Ehrenberg et al. | 343/882 |

FOREIGN PATENT DOCUMENTS

WO WO 02/075847 9/2002

OTHER PUBLICATIONS

European Search Report dated Sep. 13, 2004.

* cited by examiner

*Primary Examiner*—Don Wong
*Assistant Examiner*—Chuc Tran
(74) *Attorney, Agent, or Firm*—Nixon & Vanderhye P.C.

(57) ABSTRACT

A method for aligning a feed horn in an antenna system (100) is disclosed. The antenna system (100) includes at least one reflector surface and one or more feed horns (141, 142, . . . 145). The method includes the steps of determining a desired reflection point of the central ray from the feedhorn of the reflector surface, configuring a laser beam source to be mounted on the feed horn to enable a laser beam to travel substantially coincidently along the axis of transmission of the feed horn in a direction towards the reflector surface, and adjusting the azimuth and elevation of the feed horn to align the laser beam with the desired reflection point on the reflector surface. A laser aligning apparatus (200) for practising the above method and an antenna system aligned by means of the laser alignment apparatus (200) and/or method are also disclosed.

15 Claims, 4 Drawing Sheets

LASER ALIGNMENT APPARATUS AND METHOD

This application is the U.S. national phase of international application PCT/AU02/00691 filed on May 30, 2002, which designated the U.S. and claims priority of Australian application no. 551376 filed on Jul. 9, 2001, the entire contents of each of which are hereby incorporated by reference.

FIELD OF THE INVENTION

The present invention relates generally to reflector antennas and more specifically to alignment of an antenna feed horn with respect to the reflecting surfaces.

BACKGROUND

The ever increasing density of geostationary satellites demands increasing numbers of antennas for tracking and communication purposes. This situation can be somewhat alleviated by the use of Multibeam Antennas (MBA), whereby one antenna system can be used to receive from, and transmit to, many satellites simultaneously. As satellite antenna systems tend to be large in volumetric size, reduced real estate requirements represent a significant advantage. Each MBA has many feed horns for reception and/or transmission and the number of feed horns determines the number of satellites that can be accessed.

Alignment of a feed horn in single beam axisymmetric antennas can be achieved relatively easily by centralising the feed with respect to the main surface of the antenna and levelling the feed aperture with the antenna pointing to zenith. An example of a single beam antenna is the circularly symmetrical Cassegrain type.

MBAs, like the classical Cassegrain or Gregorian reflectors, typically employ a pair of reflector surfaces, namely a main reflector and a sub-reflector. The shape and size of the reflector surfaces are different, however, and typically a MBA has only one plane of symmetry. Multiple reflections of the beam and the lack of symmetry between the reflecting surfaces demand an alternative and more complex method of aligning the feed horns than is necessary in the case of a single beam axisymmetric antenna. Accurate alignment of each feed horn is necessary to prevent or reduce interference between adjacent beams.

Consequently, a need exists for a method and apparatus for the alignment of one or more feed horns in a multibeam antenna system.

SUMMARY

According to a first aspect of the present invention, there is provided a method for aligning a feed horn in an antenna system. The antenna system includes at least one reflector surface and one or more feed horns. The method includes the steps of determining a desired reflection point of the central ray from the feed horn on the reflector surface, configuring a laser beam source to be mounted on the feed horn to enable a laser beam to travel substantially coincidently along the axis of transmission of the feed horn in a direction towards the reflector surface, and adjusting the azimuth and elevation of the feed horn to align the laser beam with the desired reflection point on the reflector surface.

According to another aspect of the present invention, there is provided a laser alignment apparatus for aligning a feed horn relative to a reflector surface in an antenna system. The apparatus includes a device for generating a laser beam, a mounting plate whereon the device is mounted such that the laser beam generated by the device is transmitted substantially perpendicularly to the surface of the mounting plate, and means for mounting the mounting plate to the feed horn such that the mounting plate is substantially perpendicular to the axis of transmission of the feed horn.

According to another aspect of the present invention, there is provided an antenna system including at least one reflector surface, at least one feed horn, wherein the transmission axis of the feed horn is aligned with a reflection point on the reflector surface, and a laser alignment apparatus mounted on the feed horn and configured to transmit a laser beam substantially coincidently along the axis of transmission of the feed horn in a direction towards the reflector surface.

DESCRIPTION OF THE DRAWINGS

Features and preferred embodiments of the present invention are hereinafter described with reference to the accompanying drawings in which.

Like reference numerals are representative of the same elements or items across the different figures.

DETAILED DESCRIPTION

A laser alignment apparatus and a laser alignment method are disclosed hereinafter. The principles of the method and/or apparatus in accordance with the embodiments of the invention have general applicability to the alignment of point sources and/or point collectors. The included arrangements describe the application of the method and/or apparatus to align a feed horn in an asymmetrical Multibeam Antenna (MBA). However, it is not intended that the present invention be limited to the described method and/or apparatus. For example, aspects of the invention have application to the alignment of feed horns in symmetrical antenna systems or offset fed antennas that are not MBAs.

Figure 1:
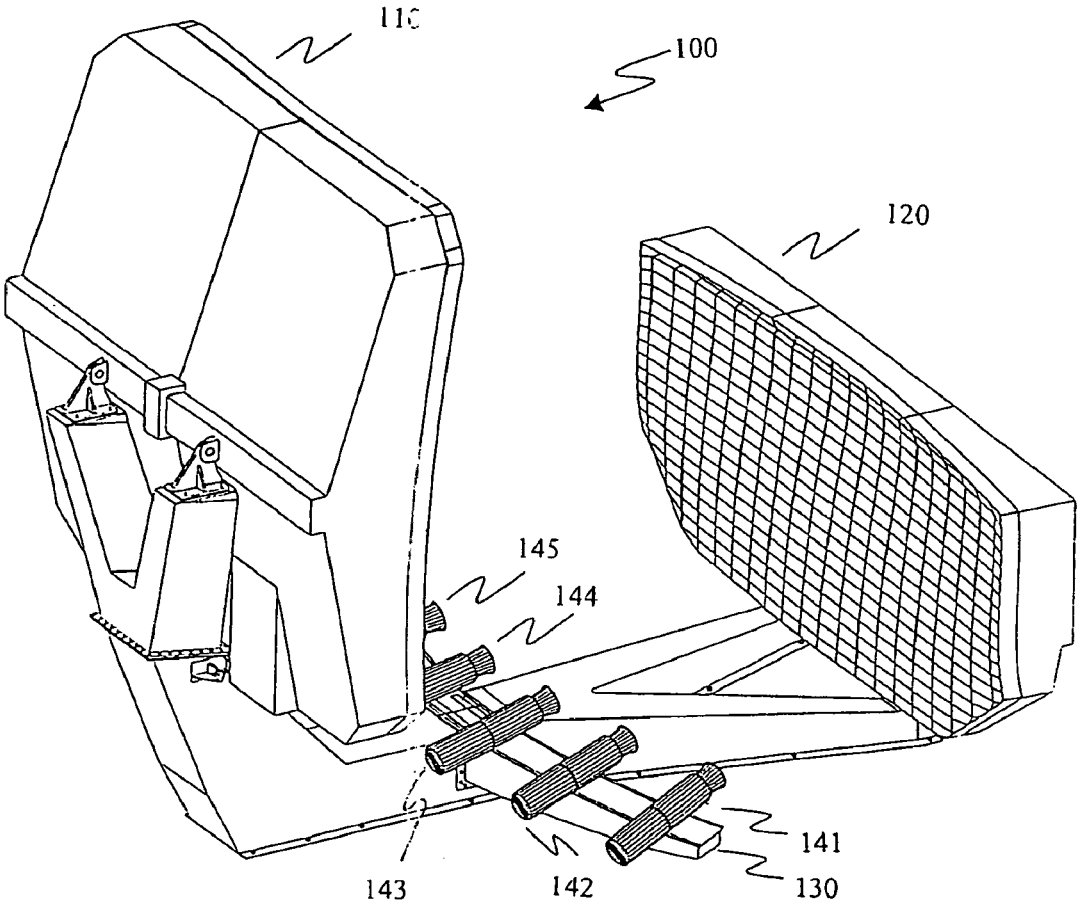
FIG. 1 is a perspective view of a Multibeam Antenna (MBA) with which embodiments of the invention can be practiced.

FIG. 1 shows a Multibeam Antenna (MBA) 100 that includes a main reflector 110, a sub-reflector 120, and a number of feed horns 141, 142, . . . 145, mounted on a support arm 130. The MBA 100 is asymmetrical, in that the main reflector 110 and the sub-reflector 120 are of different dimensions and shapes. Radio wave signals are transmitted and/or received by the feed horns 141, 142, . . . 145 via reflections off the surfaces of the sub-reflector 120 and the main reflector 110.

During installation of the MBA 100, the feed horns 141, 142, . . . 145 must be accurately aligned with respect to the sub-reflector 120 to facilitate selective illumination of the sub-reflector 120 and the main reflector 110. Selective illumination of the main reflector 110 by each one of feed horns 141, 142, . . . 145 can facilitate simultaneous communication with a number of satellites, corresponding to the number of feed horns 141, 142 . . . 145. Hence, each of the feed horns 141, 142, . . . 145 illuminates a distinct portion of the sub-reflector 120 which is turn illuminates part or all of the main reflector 110. These distinct portions to be illuminated are calculated to enable selective transfer of radio signals between a specific feed horn and a specific satellite. Careful determination thereof minimises the amount of interference between adjacent radio signal channels. The MBA 100 can preferably support up to 19 feed horns, thus providing 19 individual beams or channels for simultaneously communicating with 19 separate satellites in space. However, differing numbers of feed horns can be practiced without departing from the scope and spirit of the invention.

Figure 2:
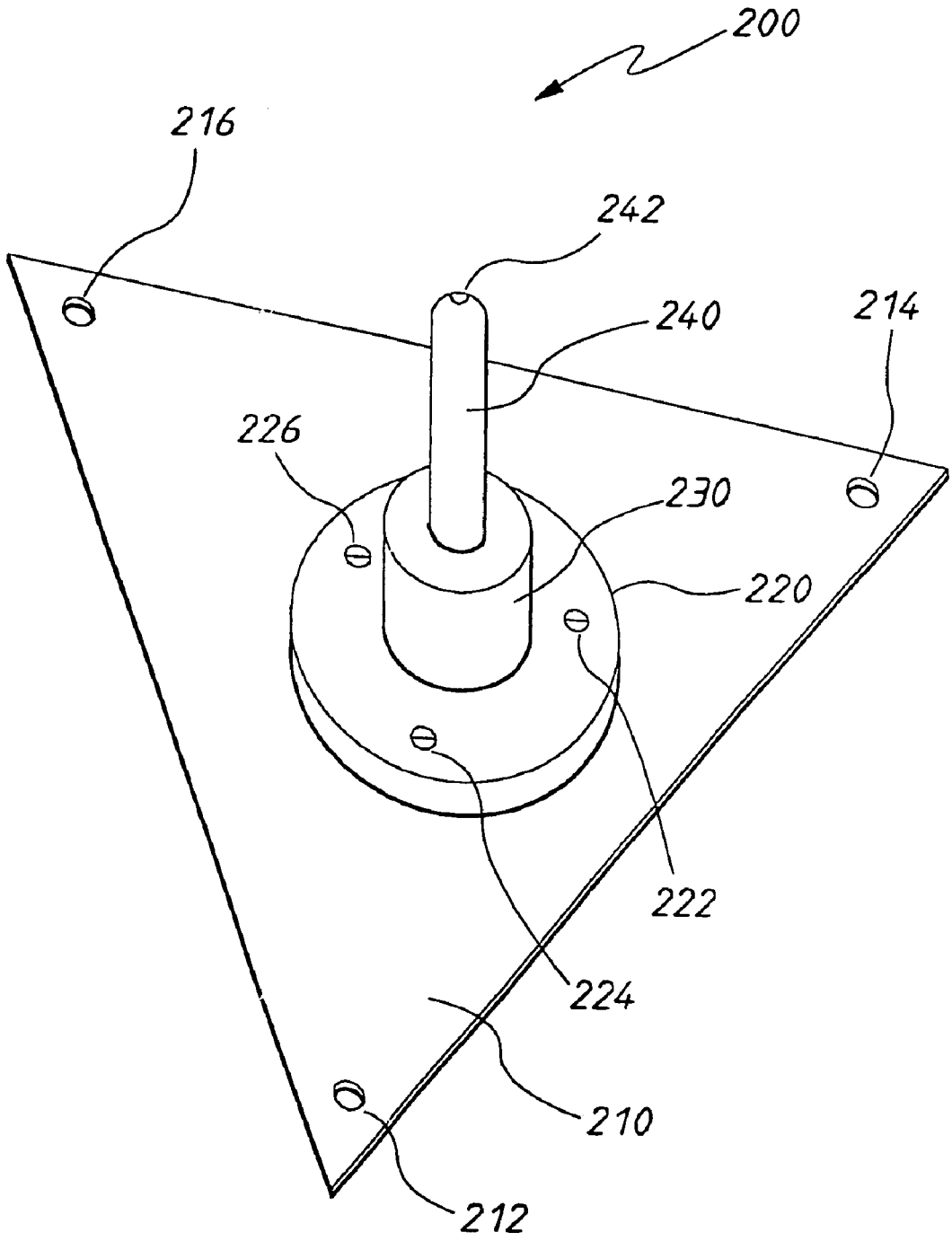
FIG. 2 is a perspective view of a laser alignment apparatus in accordance with an embodiment of the present invention.

FIG. 2 shows a laser alignment apparatus 200 in accordance with an embodiment of the present invention. The laser alignment apparatus 200 includes a mounting plate 210, the dimensions of which are selected to facilitate mounting of the apparatus 200 on the circular front-end of an antenna feed horn 141, . . . , 145. Preferably, the mounting plate 10 is triangularly shaped, although different shapes can be practiced without departing from the scope and spirit of the invention.

A disc-shaped levelling flange 220, mounted in the centre of the mounting plate 210, supports a cylindrical holder 230 that holds a laser source 240. The levelling flange 220 includes levelling screws 222, 224 and 226, the adjustment of which enables the angle of the laser source 240 to be adjusted such that a laser beam emitted from the laser source 240 is emitted perpendicularly to the surface of the mounting plate 210. Laser beam emission occurs from a 1.5 mm emission aperture 242 in the tip of the laser source 240. The size of the emission aperture 242 can be varied without departing from the scope and spirit of the invention.

The mounting plate, 210 preferably includes locating pins 212, 214 and 216, all of which protrude from a surface of the mounting plate 210. The laser source 240 is mounted on the opposite surface of the mounting plate 210. The locating pins 212, 214 and 216 enable the laser alignment apparatus 200 to be mounted on a feed horn in such a manner that a laser beam emission from the laser source 240 travels along the axis of transmission of the feed horn on which the apparatus 200 is mounted. Each of the locating pins 212, 214 and 216 are located on the circumference of a circle with centre located on the mounting plate 210 and co-incident with the axis of emission of the laser 30 source 240. Furthermore, the apparatus 200 is mounted on the feed horn 141, . . . , 145 such that the locating pins 212, 214 and 216 contact the outer circular casing of the feed horn 141, . . . , 145, thus permitting circular rotation of the apparatus 200 on the feed horn 141, . . . , 145. It will be apparent to those skilled in the art, in view of this disclosure, that variations to the locating pin mounting arrangement can be made without departing from the scope and spirit of the invention. For example, alternative mounting arrangements might include rollers, adjustable clamps, etc.

During manufacture of the main reflector 110 and sub-reflector 120, accurately positioned control marks are placed on the surface of the main reflector 110 and sub-reflector 120. The main reflector 110 and sub-reflector 120 comprise a number of panels and the control marks are typically located at the corners thereof. Alignment of the two reflecting surfaces, being the sub-reflector 120 and the main reflector 110, can be performed by use of the control marks. Alignment of a feed horn, with respect to the sub-reflector 120, can also be performed using at least three position control marks, making use of the well known method of "triangulation". It is not essential that the position control marks be located on the sub-reflector 120, however, the position control marks should be fixed in position with respect to the sub-reflector 120. Accordingly, the position control marks can be located on another part of the MBA 100, such as the frame thereof. Furthermore, it is possible to produce position control marks without producing permanent marks on the MBA 100. For example, the position control marks can be produced by means of a second laser that is setup at a reference position on the support arm 130 or an another part of the MBA 100.

Figure 3:
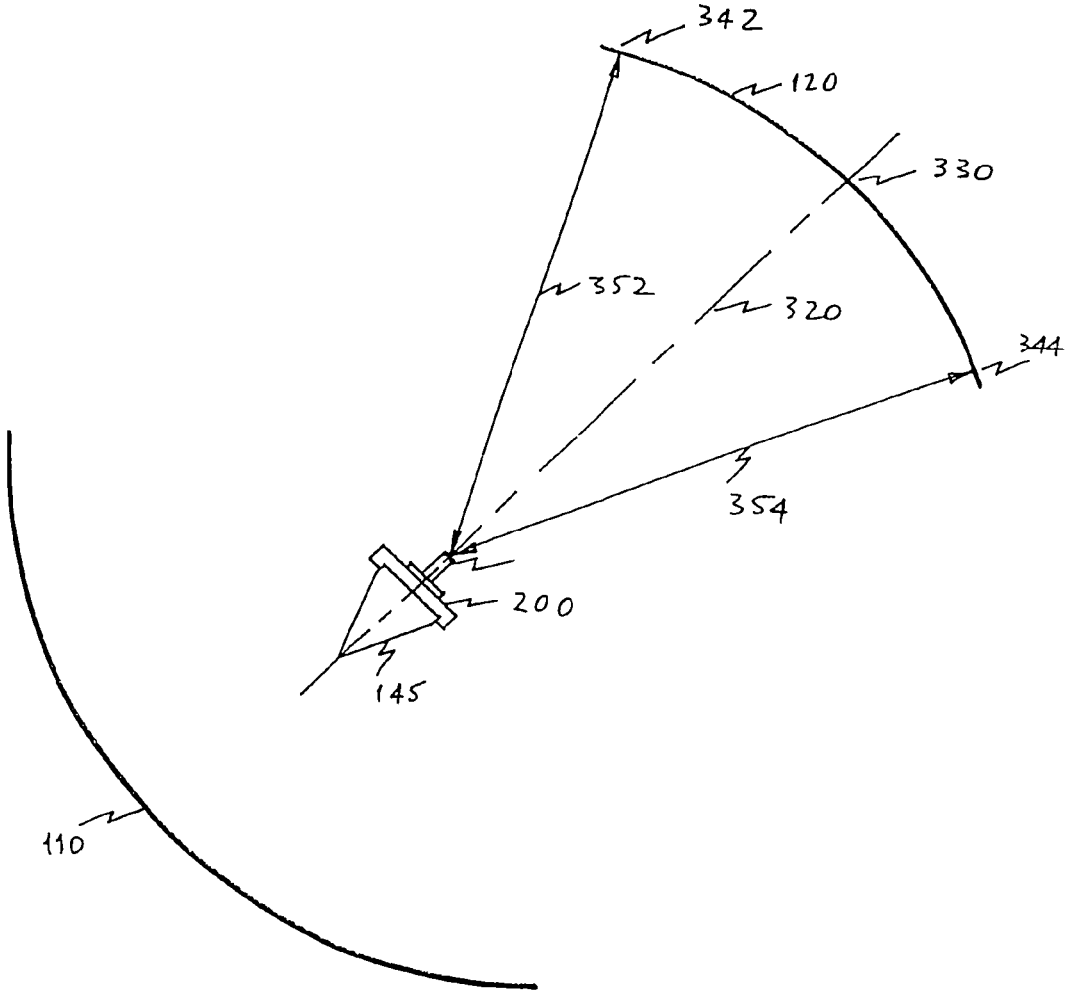
FIG. 3 is a plan view illustrating alignment of a feed horn with respect to the sub-reflector of the MBA of FIG. 1, using the laser alignment apparatus of FIG. 2.

FIG. 3 shows geometric alignment of a feed horn 145 with respect to a sub-reflector 120, assuming that the sub-reflector 120 has already been aligned with respect to the main reflector 110. Two position control marks 342 and 344 are shown on the sub-reflector 120. A further two position control marks (not shown) are typically located directly below the position control marks 342 and 344, and at the other end of the sub-reflector 120. The position control marks typically comprise holes of 1.5 mm diameter, drilled through the sub-reflector 120 or indicated by a second laser. A laser alignment apparatus 200 is shown mounted over the aperture of the feed horn 145. The laser alignment apparatus 200 is mounted on the feed horn 145 in a manner such that a laser beam can be transmitted substantially coincidently along the axis of transmission 320 of the feed horn 145 in a direction towards the sub-reflector 120. The laser beam, representing the axis of transmission 320 of the feed horn 145, is thus visible at a point 330 on the surface of the sub-reflector 120. Dimensions 352 and 354 represent the distance between the aperture 242 of the laser alignment apparatus 200 and the position control marks 342 and 344, respectively.

Figure 4:
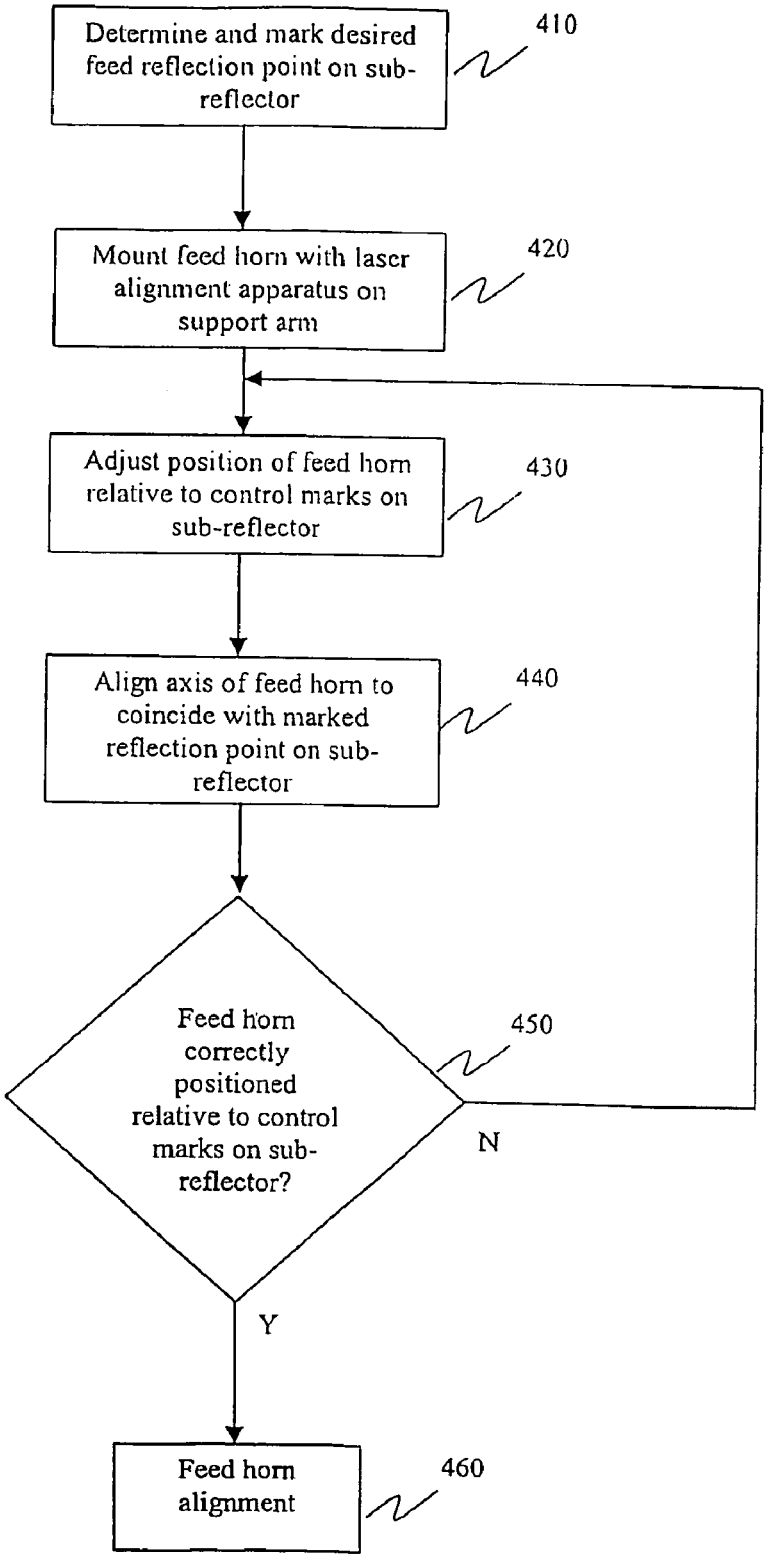
FIG. 4 is a flow diagram showing a method of alignment of a feed horn with respect to the sub-reflector of a Multibeam Antenna (MBA) in accordance with the embodiment shown in FIG. 2

FIG. 4 shows a flow diagram of a method of alignment of a feed horn with respect to a sub-reflector of a multibeam antenna.

At step 410, the desired reflection point, of the central ray from the feed horn to be aligned, is located and marked on the surface of the sub-reflector 120. The desired location of the reflection point on the sub-reflector 120 is determined in accordance with the design configuration of the multi beam antenna 100, preferably using a geometric modelling computer program. Based on the design configuration of the antenna (eg. specific curvature of the reflector surface, location and number of feed horns, etc) and the geostationary location of a particular satellite to be tracked, the computer program is used to determine the location of the reflection point relative to at least three position control marks on the surface of the sub-reflector 120. The desired reflection point, on the surface of the sub-reflector 120, is located by chordal measurement from at least three position control marks 342, 344 . . .

At step 420, the feed horn 145 is mounted on the support arm 130 of the MBA 100. The laser alignment apparatus 200 is mounted on the surface of the feed horn 145 closest to the sub-reflector 120. The laser apparatus 200 is mounted in such a manner that a laser beam emitted therefrom is transmitted substantially coincidently along the axis of transmission 320 of the feed horn 145.

At step 430, the position of the feed horn is adjusted relative to at least three of the control marks on the sub-reflector 120. Such adjustment entails measurement of the distances between the emission aperture 242 of the laser alignment apparatus 200 and the at least three position control marks on the surface of the sub-reflector 120. The dimensions 352 and 354, in FIG. 3, show the distance to be measured between the laser emission aperture 242 and two position control marks 342 and 344, respectively. The specific distance values are calculated according to the design configuration of the MBA 100, by the geometric modelling computer program. The critical distances extend between the actual radio wave emission point, in the feed horn 145, to the position control marks 342 and 344 on the surface of the sub-reflector 120. The distance between the actual radio wave emission point, in the feed horn 145, to the emission aperture 242 constitutes a fixed offset that is compensated for in the geometric modelling computer program. For purposes of these measurements, measuring tapes of exact length have been used. Contact tips from conventional dial gauges are preferably used on each end of the measuring tapes as the tips located perfectly in the 1.5 mm laser emission aperture 242 and the 1.5 mm drilled position control marks.

At step 440, the axis of the feed horn 145 is aligned to coincide with the marked reflection point on the sub-reflector 120 by aligning the laser beam to illuminate the marked reflection point. The azimuth and elevation of the feed horn 145 are adjusted to perform this alignment. Once the laser beam is aligned to coincide with the marked reflection point, the laser alignment apparatus 200 can be rotated on the feed horn 145, as earlier described. If the laser source 240 is not mounted perpendicularly to the mounting plate 210 and/or the surface of the feed horn 145, such rotation of the apparatus 200 causes the laser beam to trace a circle on the surface of the sub-reflector 120. The centre of the traced circle, which can be determined by bisection of the circle, should then be aligned with the marked reflection point.

At step 450 the distances between the emission aperture 242 of the laser alignment apparatus 200 and at least three position control marks on the surface of the sub-reflector 120 are measured. If any of these measurements are not within a desired tolerance (N), the position of the feed horn 145 is again adjusted at step 430. Once it is determined that the feed horn 145 is correctly positioned relative to the control marks on the sub-reflector 120 (Y) and points towards the reflection point on the sub-reflector 120, the alignment procedure is complete.

The foregoing describes only a few arrangements and/or embodiments of the present invention, and modifications and/or changes can be made thereto without departing from the scope and spirit of the invention, the arrangements and/or embodiments being illustrative and not restrictive.

The invention claimed is:

1. A method for aligning a feed horn in an antenna system, said antenna system including at least one reflector surface and one or more feed horns, said method comprising the steps of:

providing at least three position control marks fixed in position relative to said at least one reflector surface for aligning said feed horn;

determining a desired position for the reflection point of the central ray from said feed horn from a plurality of possible positions on said reflector surface;

configuring a laser beam source to be mounted on said feed horn to enable a laser beam to travel substantially coincidently along the axis of transmission of said feed horn and in a direction towards said reflector surface; and adjusting the azimuth and elevation of said feed horn to align said laser beam with the desired reflection point on said reflector surface.

2. The method of claim 1, wherein said desired position for said reflection point, on said reflector surface, is determined relative to said position control marks.

3. The method of claim 1, wherein said position control marks are located on said reflector surface.

4. The method of claim 1, comprising the further step of positioning said feed horn relative to said reflector surface using said position control marks.

5. The method of claim 4 wherein said positioning and adjusting steps are performed repeatedly until measured values of said position and alignment of said feed horn are determined to be within specified limits.

6. The method of claim 1, wherein said desired position is determined based on a location of a satellite for aligning said feed horn with said satellite.

7. An antenna system comprising a plurality of feed horns and at least one reflector surface, wherein at least one of said feed horns is aligned in accordance with the method of claim 1.

8. A laser alignment apparatus for aligning a feed horn relative to a reflector surface in an antenna system, said apparatus comprising:

a laser source for generating a laser beam; and at least three position control marks fixed in position relative to the reflector surface for aligning feed horns in the antenna system;

a mounting plate, whereon said laser source is mounted such that said laser beam generated by said laser source is transmitted substantially perpendicularly to the surface of said mounting plate; and means for mounting said mounting plate to said feed horn such that said mounting plate is substantially perpendicular to the axis of transmission of said feed horn;

wherein said mounting plate is configured to rotate relative to said feed horn in a plane perpendicular to the axis of transmission of said feed horn when said apparatus is mounted over the aperture of said feed horn.

9. The laser alignment apparatus of claim 8, wherein the angle of transmission of said laser beam, relative to said mounting plate, is adjustable.

10. An antenna system, comprising:

at least one reflector surface;

at least three position control marks fixed in position relative to said reflector surface for aligning feed horns in said antenna system;

at least one feed horn, wherein the transmission axis of said feed horn is aligned with a desired reflection point selected from a plurality of possible positions on said reflector surface; and a laser alignment apparatus mounted on said feed horn and configured to transmit a laser beam substantially coincidentally along the axis of transmission of said feed horn in a direction towards said reflector surface.

11. The system of claim 10, wherein the position of said reflection point on said reflector surface is determined relative to said position control marks.

12. The system of claim 10, wherein said position control marks are located on said reflector surface.

13. The system of claim 10, wherein said feed horn is positioned relative to said reflector surface, using said position control marks.

14. The system of claim 10, wherein said laser alignment apparatus comprises:

a laser source for generating said laser beam;

a mounting plate, whereon said laser source is mounted such that said laser beam generated by said laser source is transmitted substantially perpendicularly to the surface of said mounting plate; and means for mounting said mounting plate to said feed horn such that said mounting plate is substantially perpendicular to the axis of transmission of said feed horn.

15. The antenna system of claim 10, wherein said desired reflection point is selected based on a location of a satellite for aligning said feed horn with said satellite.

* * * * *